US006965351B1

(12) United States Patent
Miller et al.

(10) Patent No.: US 6,965,351 B1
(45) Date of Patent: Nov. 15, 2005

(54) DUAL-FREQUENCY-ILLUMINATING REFLECTOR

(75) Inventors: Julie Miller, Auberry, CA (US); William J. Taft, Yardville, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 10 days.

(21) Appl. No.: 10/812,593

(22) Filed: Mar. 29, 2004

(51) Int. Cl.[7] ..... H01Q 13/00
(52) U.S. Cl. ..... 343/781 P; 343/781 CA
(58) Field of Search ..... 343/781 R, 781 P, 343/781 CA, 753, 756, 783, 909, 910

(56) References Cited

U.S. PATENT DOCUMENTS 5,373,302 A * 12/1994 Wu ..... 343/781 P
6,252,559 B1 * 6/2001 Donn ..... 343/781 CA
6,795,034 B2 * 9/2004 Lyerly et al. ..... 343/781 CA

OTHER PUBLICATIONS

S. Shambayati, "On the Use of W-Band for Deep-Space Communications", IPN Progress Report 42-154, Aug. 15, 2003, pp. 1-17.

* cited by examiner

*Primary Examiner*—Hoang V. Nguyen
(74) *Attorney, Agent, or Firm*—McDermott Will & Emery LLP

(57) ABSTRACT

An illuminating reflector system is provided for transmitting first and second frequency bands for satellite and terrestrial communications. The illuminating reflector includes a first reflector configured to transmit a first portion of the first frequency band in an dispersed beam, to reflect a second portion of the first frequency band, and to transmit the second frequency band; a second reflector configured to reflect the second frequency band received from the first reflector; and a primary reflector configured to receive the second portion of the first frequency band reflected from the first reflector, to receive the second frequency band reflected from the second reflector, and to reflect the second portion of the first frequency band and the second frequency band in a substantially collimated beam.

40 Claims, 8 Drawing Sheets

DUAL-FREQUENCY-ILLUMINATING REFLECTOR

BACKGROUND OF THE INVENTION

The present invention relates to satellite communication systems. More particularly the present invention relates to a dual-frequency-illuminating reflector that provides cross-link communications with other satellites and provides terrestrial communications.

Modern satellites provide high bandwidth communications for military applications, telecommunications, and television as well as others fields. Costs associated with launching satellites into Earth orbits increase significantly in proportion to increased satellite weight. Accordingly, one goal of satellite manufacturers is to manufacture satellites as light as feasibly possible while continuing to provide high bandwidth communications.

A traditional satellite in cross-communication with other satellites typically transmit a frequency band through two transmitters. The frequency band is typically transmitted as an dispersed beam by a first transmitter and as a collimated beam by a second transmitter. FIG. 1 shows an example of a typical satellite 100 having a first transmitter 105 configured to transmit a frequency band in an dispersed beam 110 and a second transmitter 115 configured to transmit the frequency band in a collimated beam 120. The dispersed beam may be used by a satellite 125 for initially acquiring the dispersed beam and for tracking the dispersed beam to lock onto and collect the collimated beam, which may be a modulated beam. Because two transmitters are typically used to transmit dispersed and collimated beams, additional weight is added to the traditional satellite that raises the cost of launch as well as the cost of design and manufacture.

Accordingly, there is a need for satellites that are light, and yet are capable of transmitting frequency bands in dispersed and collimated beams for satellite and terrestrial acquisition and communication.

BRIEF SUMMARY OF THE INVENTION

The present invention provides a satellite communication system. More particularly the present invention provides a dual-frequency-illuminating reflector that provides cross-link communications with other satellites and provides terrestrial communications.

According to one embodiment, an illuminating-reflector system is provided for transmitting first and second frequency bands for satellite and terrestrial communications. The illuminating reflector system includes a first reflector configured to transmit a first portion of the first frequency band in an dispersed beam, to reflect a second portion of the first frequency band, and to transmit the second frequency band; a second reflector configured to reflect the second frequency band received from the first reflector; and a primary reflector configured to receive the second portion of the first frequency band reflected from the first reflector, to receive the second frequency band reflected from the second reflector, and to reflect the second portion of the first frequency band and the second frequency band in a substantially collimated beam. According to a specific embodiment, the first portion includes about five percent or less of the power of the first frequency band and the second portion includes about ninety-five percent or more of the power of the first frequency band. According to another specific embodiment, the first frequency band includes at least one of the millimeter band, the microwave band, the Ka-band, the V-band and the second frequency band includes the Ka-band.

According to another specific embodiment, a satellite is provided for dual-frequency cross-link communications with at least one other satellite and for terrestrial communications. The satellite includes a dual-frequency-illuminating reflector configured to transmit a first frequency band in a first collimated beam and in an dispersed beam, and to transmit a second frequency band in a second collimated beam. According to a specific embodiment, the dispersed beam is a low-gain beam and the first and second collimated beams are high-gain beams. According to another specific embodiment, the dual-frequency-illuminating reflector includes: a first reflector configured to transmit a first portion of the first frequency band in an dispersed beam, to reflect a second portion of the first frequency band, and to transmit the second frequency band; a second reflector configured to reflect the second frequency band received from the first reflector; and a primary reflector configured to receive the second portion of the first frequency band reflected from the first reflector, to receive the second frequency band reflected from the second reflector, and to reflect the second portion of the first frequency band and the second frequency band in a substantially collimated beam.

Numerous benefits may be achieved using embodiments of the present invention over conventional techniques. For example, an embodiment of the invention provides for transmitting first and second frequency bands employing a single illuminating reflector, thereby providing a satellite that is relatively light weight and accordingly relatively inexpensive to manufacture and launch. The embodiment provides that at least one of the frequency bands is transmitted in an dispersed beam and a collimated beam providing for fast acquisition and tracking of transmitted frequency bands. As the illuminating reflector is configured to transmit two or more frequency bands, communications having a variety data transmission rates may be transmitted providing high and low rates of information transmission to other satellites and to terrestrial receivers. In other embodiments, the invention provides transmission and reception of multiple frequencies with a single illuminating reflector. Depending upon the specific embodiment, there can be one or more of these benefits. These and other benefits can be found throughout the present specification and more particularly below.

A further understanding of the nature and advantages of the present invention may be realized by reference to the remaining portions of the specification and the drawings.

DETAILED DESCRIPTION OF THE INVENTION

The present invention provides a satellite communication system. More particularly the present invention provides a dual-frequency-illuminating reflector that provides crosslink communications with other satellites and provides terrestrial communications.

Figure 1:
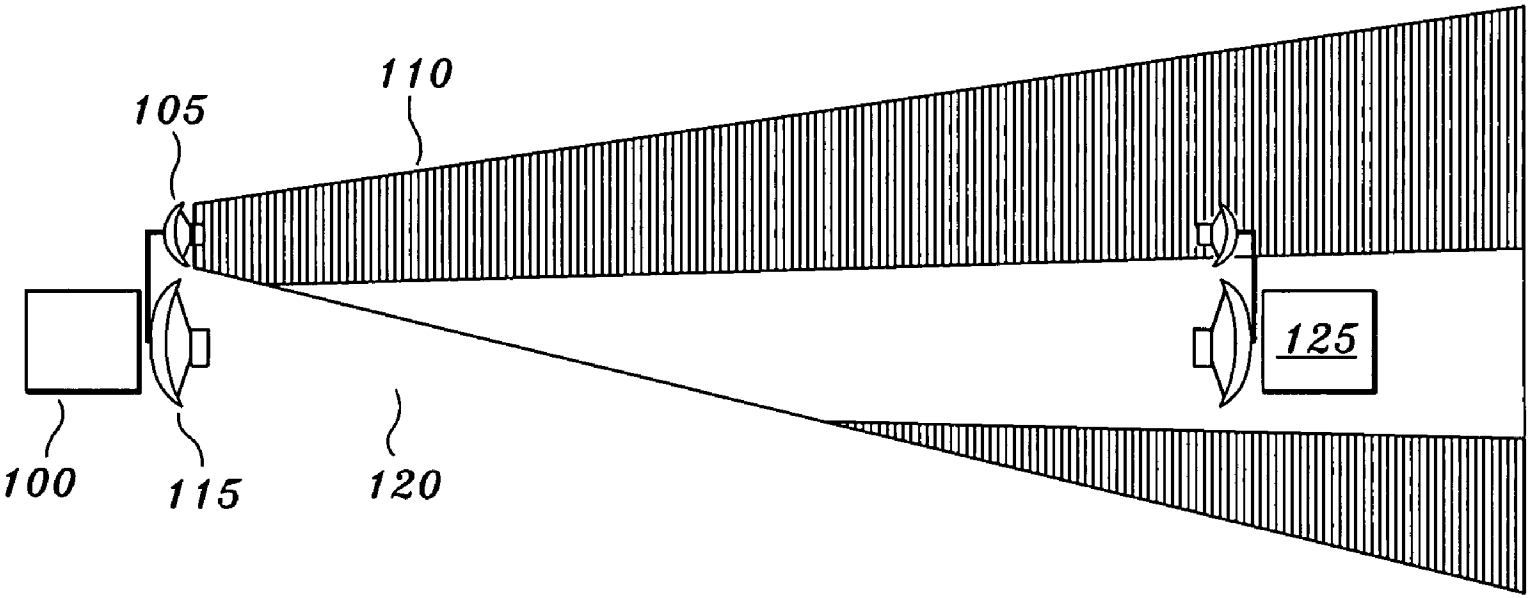
FIG. 1 (PRIOR ART)
FIG. 1 shows an example of a satellite having a first transmitter configured to transmit a frequency band in a dispersed beam and a second transmitter configured to transmit the frequency band in a collimated beam.
Figure 2:
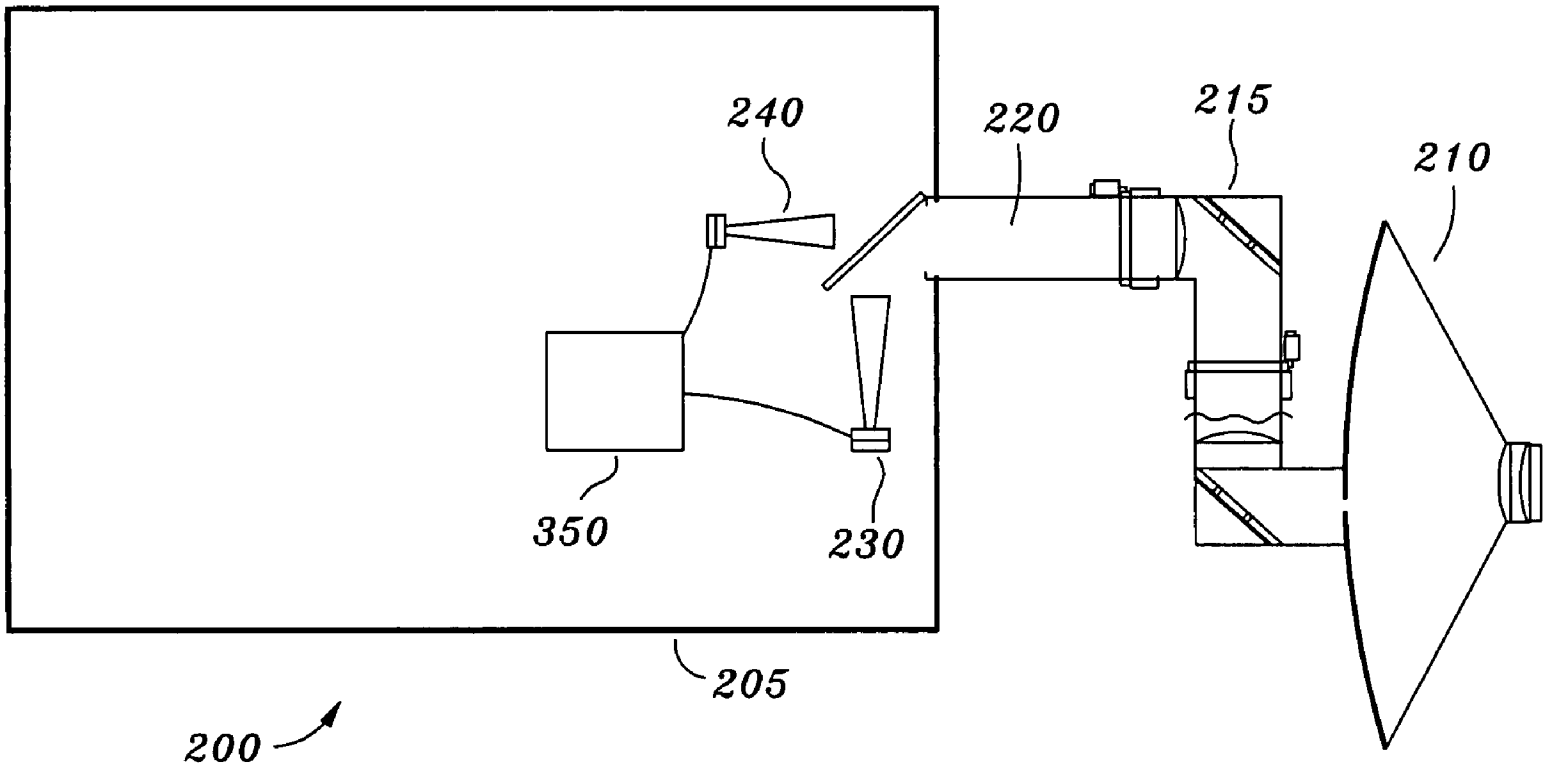
FIG. 2 is a simplified schematic of a satellite according to an embodiment of the present invention.

FIG. 2 is a simplified schematic of a satellite 200 according to an embodiment of the present invention. Satellite 200 includes a satellite bus 205 and an illuminating reflector 210. Satellite bus 205 is coupled to illuminating reflector 210 via a control arm 215. Control arm 215 may have one or more gimbals configured to rotate (or slew) illuminating reflector 210. Control arm 215 may include a beam waveguide 220 configured to deliver two or more frequency bands of electromagnetic radiation from the satellite bus to the illuminating reflector.

Figure 3:
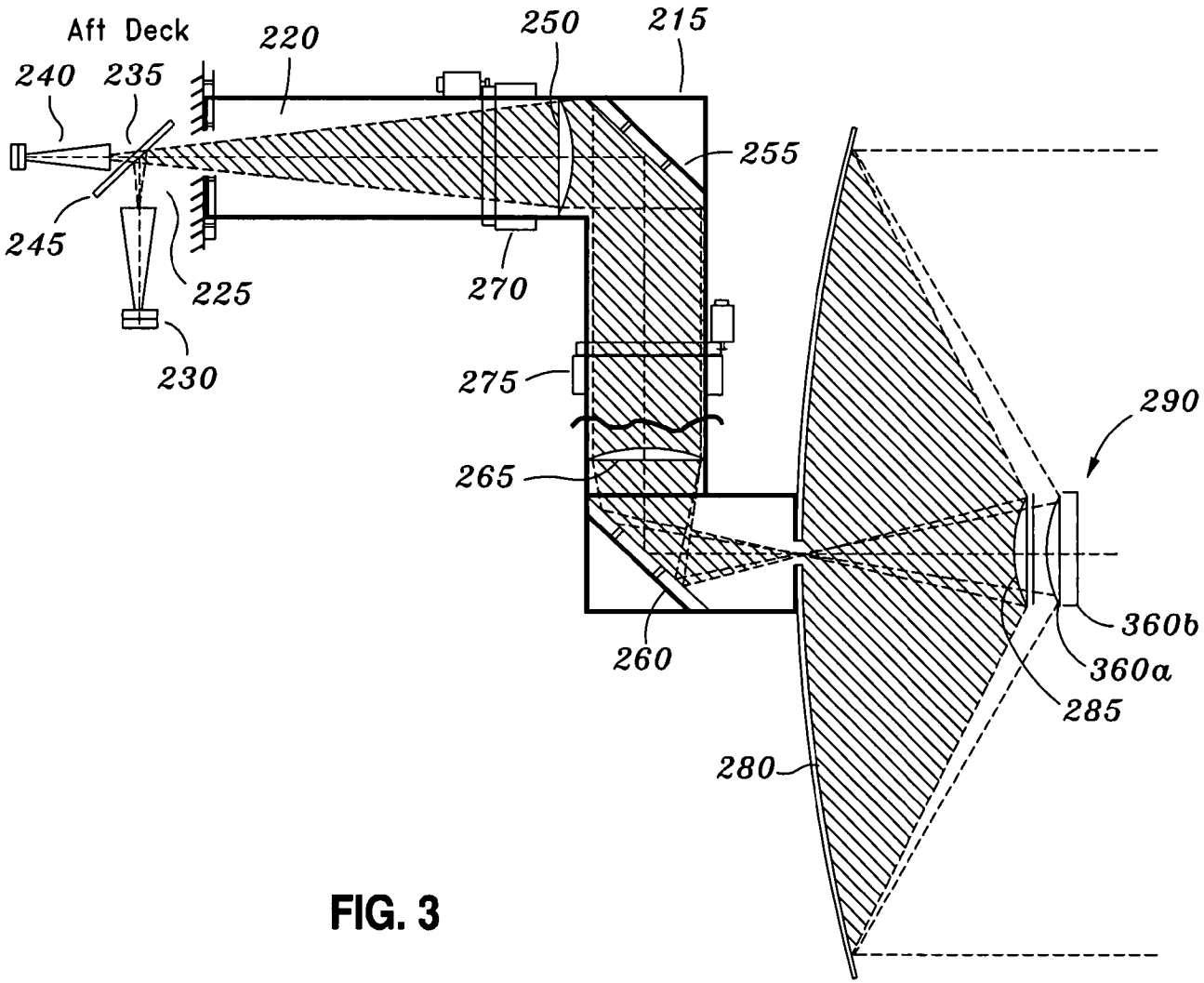
FIG. 3 is a detailed schematic of a control arm and an illuminating reflector according to an embodiment of the present invention.

FIG. 3 is a detailed schematic of control arm 215 and illuminating reflector 210 according to an embodiment of the present invention. The control arm and illuminating reflector may be coupled to an aft deck of the satellite bus and may be configured to receive a first frequency band 225 from a first feed horn 230 and receive a second frequency band 235 from a second feed horn 240. The first frequency band may be the millimeter band, the microwave band, the Ka-band, or the V-band, and the second frequency band may be a frequency band different than the first frequency band. The first frequency band may be used for crosslink satellite communications and the second frequency band may be used for downlink communications, such as direct downlink communications.

The first and second frequency bands may be directed into beam waveguide 220 by a dichroic surface 245 that is configured to reflect the first frequency band and transmit the second frequency band. The first and second frequency bands may be collimated in the beam waveguide by a collimating lens 250. First and second flat reflectors 255 and 260, respectfully, may be configured to direct the first and second frequency bands through the beam waveguide. A lens 265, such as a converging lens, may be used to focus the collimated beam such that the first and second frequency bands exit the beam waveguide focused to a relatively small cross-sectional area. While, lens 265 is shown disposed between the reflectors 255 and 260, lens 255 may be disposed at a variety of locations within the beam waveguide, such as disposed between reflector 260 and the end of the beam waveguide. Two or more gimbals, such as gimbals 270 and 275, may be configured to variously slew illuminating reflector 210. For example, a beam waveguide having three or four ninety-degree bends may have three or four gimbals, respectively, to slew reflector 210 through 4$\pi$ (or other) scan motion.

Figure 4A:
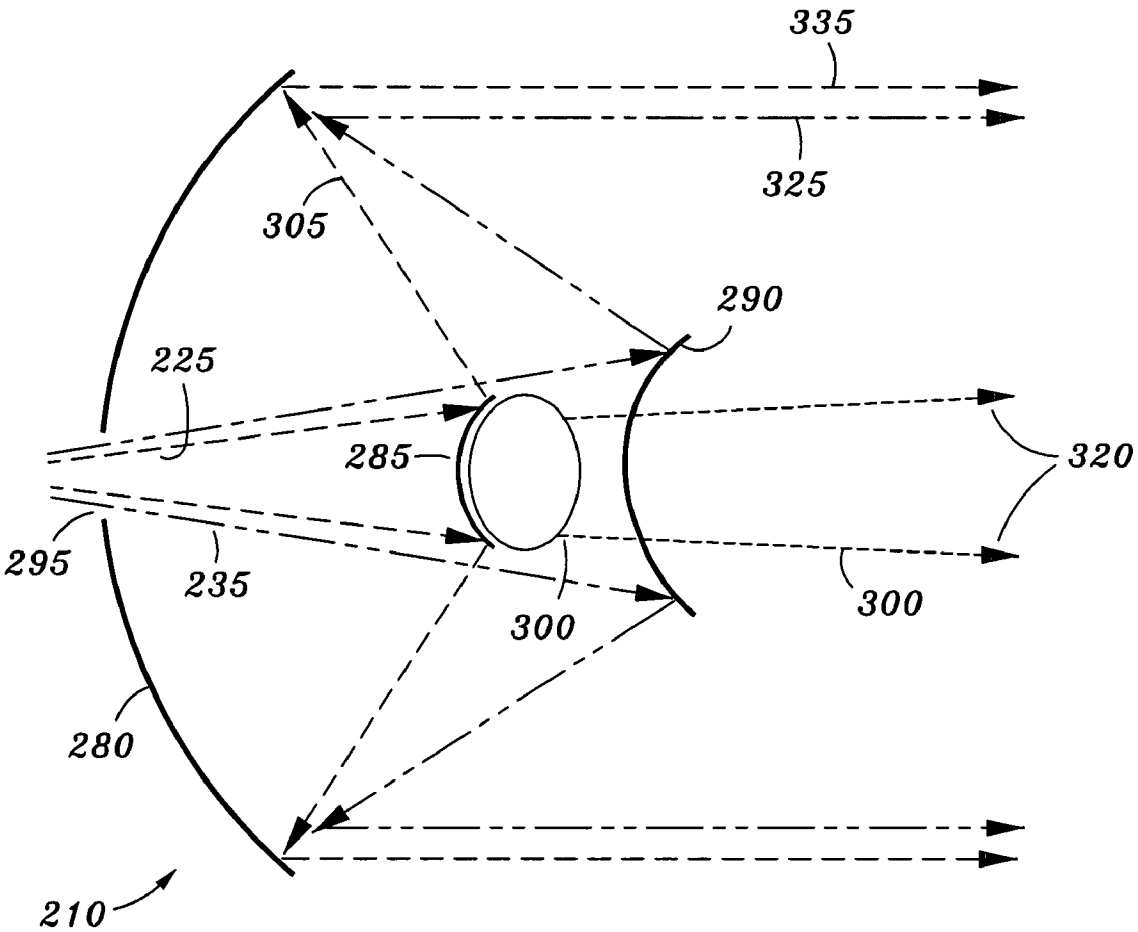
FIG. 4A is a further detailed schematic of the illuminating reflector according to an embodiment of the present invention.

FIG. 4A is a further detailed schematic of illuminating reflector 210 according to an embodiment of the present invention. Illuminating reflector 210 includes a primary reflector 280, a first reflector 285, and a second reflector 290. The first reflector is disposed between the primary reflector and the second reflector, and is optically upstream from the primary reflector and the second reflector. The primary reflector is optically upstream from the second reflectors. Primary reflector 280 may be a parabolic mirror or the like and may have a diameter of about 5.5 feet or more. According to one embodiment, primary reflector 280 has a diameter of about 6 feet to about 8 feet, and according to a specific embodiment has a diameter of about 6 feet (or approximately two meters). The first reflector may be a concave or convex mirror and have a diameter of approximately 4 inches or greater, such as about 10 inches or about 12 inches. According to one embodiment, primary reflector 280 and first reflector 285 form a Cassegrain reflector, a Gregorian reflector or the like. The second reflector may have a diameter between the diameters of the primary reflector and the first reflector.

The first and second frequency bands 225 and 235 (focused by lens 265) are configured to pass through an aperture 295 formed in the primary reflector 280. The first and second frequency bands are configured to diverge after passing through aperture 295 and are transmitted to the first reflector. The first frequency band at the first reflector may have a wavefront diameter approximately equal to or less than the diameter of the first reflector.

According to one embodiment, the first and second reflectors are configured to transmit a first portion 300 of the first frequency band, and the first reflector is configured to reflect a second portion 305 of the first frequency band. The first and second reflectors transmit portion 300 such that the wavefronts travel in an dispersed beam 320. Reflected portion 305 is received and reflected by primary reflector 280. The reflected portion of the first frequency band travels in an essentially collimated beam 325.

Figure 4B:
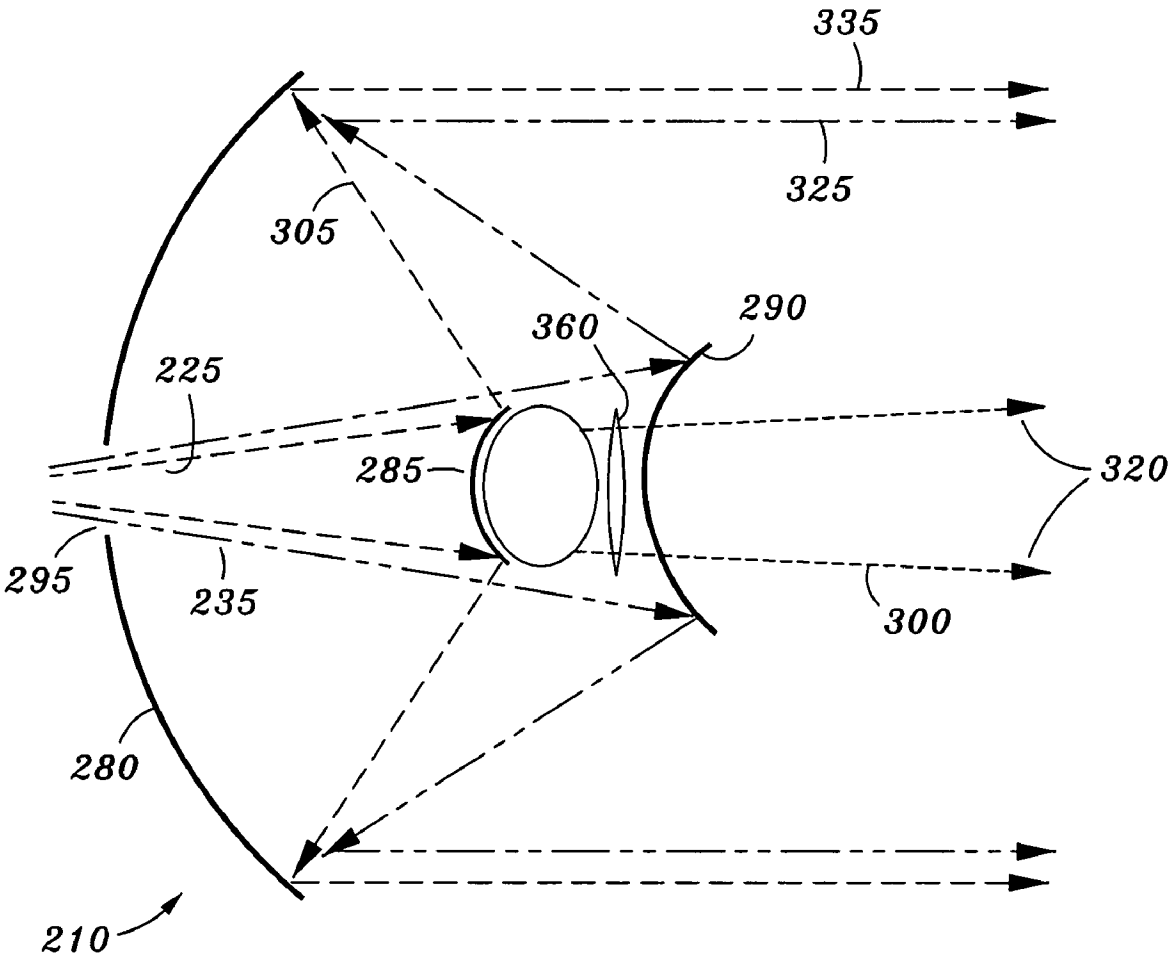
FIG. 4B is a further detailed schematic of an illuminating reflector according to another embodiment of the present invention.

Transmitted portion 300 of the first frequency band in dispersed beam 320 may have a lower intensity than the reflected portion 305 in collimated beam 325. The dispersed beam may have, for example, approximately five percent or less of the power of the first frequency band transmitted to the first reflector and the reflected portion may have approximately ninety-five percent or more of the power of the first frequency band transmitted to the first reflector. According to one embodiment, a dielectric lens 360 (see FIG. 4B) is used to control the width of dispersed beam 320. While dielectric lens 360 is shown to be disposed between the first reflector and the second reflector, the dielectric lens may be alternately disposed, such as between primary reflector 280 and first reflector 285, or may be disposed in front of the second reflector 290. Primary reflector 280 may be characterized as a high-gain antenna having, for example, a gain greater than about 50 dBi or greater, such as about 59 dBi. According to a specific embodiment, the gain of the primary reflector is approximately 59.5 dBi. First reflector 285 may be characterized as a low-gain reflector and may have a gain of approximately −20 dBi or less relative to the gain of the primary reflector. According to a specific embodiment, the gain of the first reflector may be about −33 dBi relative to the gain of the primary reflector.

According to one embodiment, the first reflector is configured to transmit the second frequency band 235. While the second frequency band shown in FIG. 4A has a wavefront diameter at the first reflector that is greater than the diameter of the first reflector, this is not necessary, the wavefront diameter of the second frequency band at the first reflector may be approximately equal to or less than the diameter of the first reflector. The second reflector is configured to reflect the second frequency band to the primary reflector, which in turn is configured to reflect the second frequency band into an approximately collimated beam 335. According to one embodiment, collimated beams 325 and 335 have approximately equal wavefront diameters.

As the first reflector is configured to reflect portions of the first frequency band and transmit the second frequency band, the first reflector may be characterized as a dichroic reflector. The second reflector may similarly be characterized as a dichroic reflector as the second reflector is configured to reflect the second frequency band and transmit the first frequency band. The transmission and reflection properties of the first and second reflectors may be achieved by appropriately coating one or more surfaces of the first and second reflectors with frequency/wavelength selective transmission and reflection coatings, such as dichroic layers.

Figure 5B:
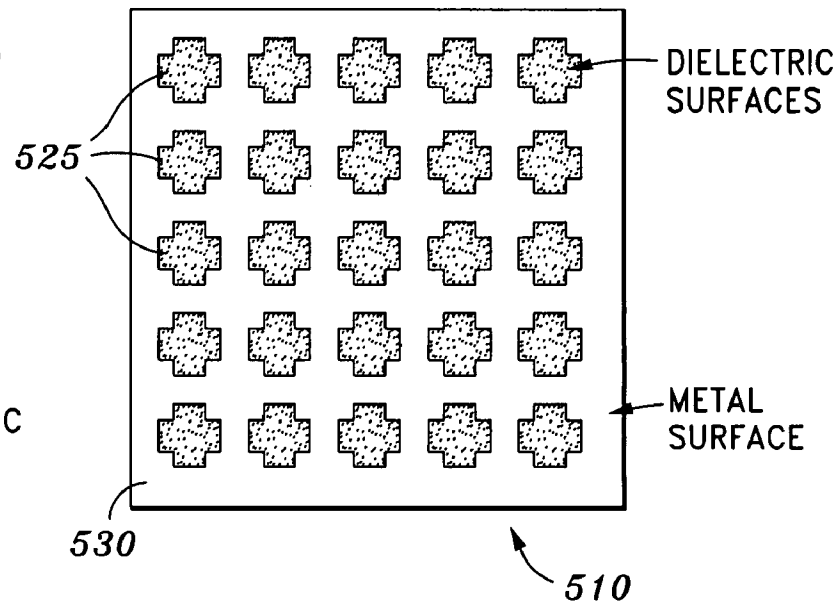
FIGS. 5A and 5B are simplified schematics of dichroic surface according to an embodiment of the present invention.
Figure 5A:
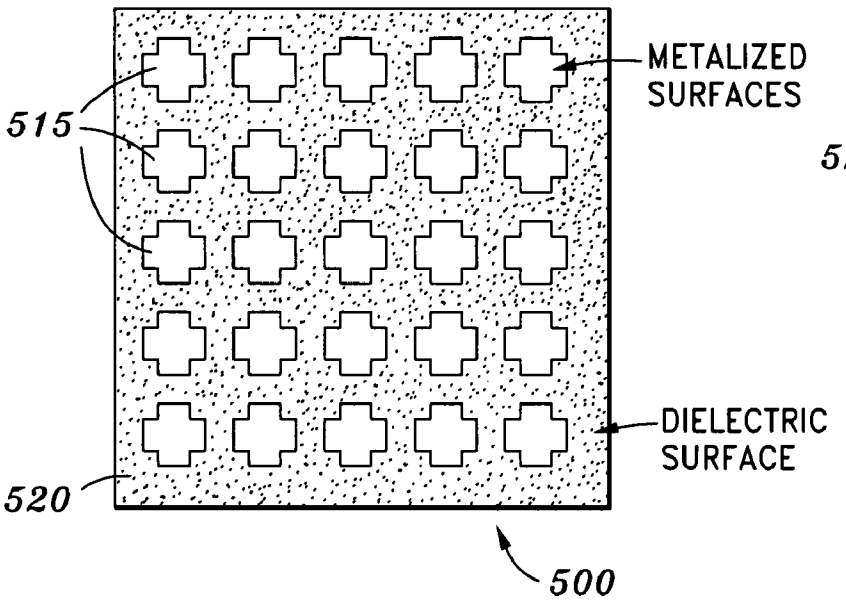

FIGS. 5A and 5B are simplified schematics of dichroic layers 500 and 510, respectively, according to embodiments of the present invention. The dichroic layers are configured to control transmission and reflection of electromagnetic radiation. One or more dichroic layers, such as dichroic layers 500 and 510, may be disposed on the surfaces of one or more elements configured to direct and/or provide focusing of the transmitted and collected beams. For example, one or more the surfaces of illuminating reflector 210, surface 245, first reflector 285, and second reflector 290 may be coated with one or more dichroic layers to form a dichroic surface and to selectively control transmission and reflection of electromagnetic radiation.

According to one embodiment, dichroic layer 500 includes a plurality of metal portions 515 and a dielectric portion 520. Dichroic surface 510 includes a plurality of dielectric portions 525 and a metal portion 530. The metal portions may be formed of copper or other metals of use that are known by those of skill in the art. The dielectric portions may include a polymer, such as polyamide, polymides, or polyimide, such as Kapton™ of DuPont. The metal portions may be formed on a dielectric sheet to form the dichroic layers.

The dichroic layers are configured to provide selective reflectivity and/or transmission of electromagnetic radiation based on a resonant frequency of the electromagnetic radiation. Wavelength selective reflectively and transmission may be controlled by coating a surface with one or more of the dichroic layers. Frequency discrimination (e.g., reflection of one wavelength and transmission of another wavelength) may be enhanced by providing an optimized separation in the frequency of disparate beams. For example, a frequency ratio of at least 2:1 or greater may be used to optimize frequency discrimination by dichroic surfaces. According to one embodiment, a frequency ratio of different beams of at least 3:1 is used. According to another embodiment, a frequency ratio of different beams of at least 4:1 is used.

A metal pattern geometry of metal portions 515 and 530 may be configured to provide a frequency-dependent resonance to allow a desired signal to reflect from a dichroic surface or transmit through a dichroic surface. To the first order, a dichroic surface appears to be a continuous metallic surface for a given frequency of an incident signal, and therefore, reflects substantially all of an incident signal with relatively low signal loss, or transmits substantially all of an incident signal thru the dichroic surfaces with relatively low attenuation.

FIGS. 5A and 5B show a limited number of metal patterns (e.g., metal size, spacing, and shape) that may be used to control reflection and transmission. Other metal patterns may be used for frequency selective reflection and transmission and will be known by those of skill in the art. According to one embodiment, multiple metal patterns of a number of dichroic layers may be used to optimize frequency selectivity for reflection and transmission. Metal patterns on dichroic surfaces can be varied dependent on particular applications. For example, the metal pattern of dichroic layer 500, having metalized crossed (or "X" patterns) may be used for transmission of relatively lower frequency signals, and reflection of relatively high frequency signals. Those of skill in the art will be familiar with the specific frequency ranges for which transmission and reflection are optimal using dichroic layer 500. Dichroic surface 510 may be used if the opposite effect is desired, specifically, the transmission of relatively high frequency signals, and the reflection of relatively low frequency signals. According to embodiments of the present invention, a number of dichroic layers having a number of metal patterns may be used to reduce losses in transmission and reflection to less than approximately 0.2 to 0.3 dB.

Figure 6:
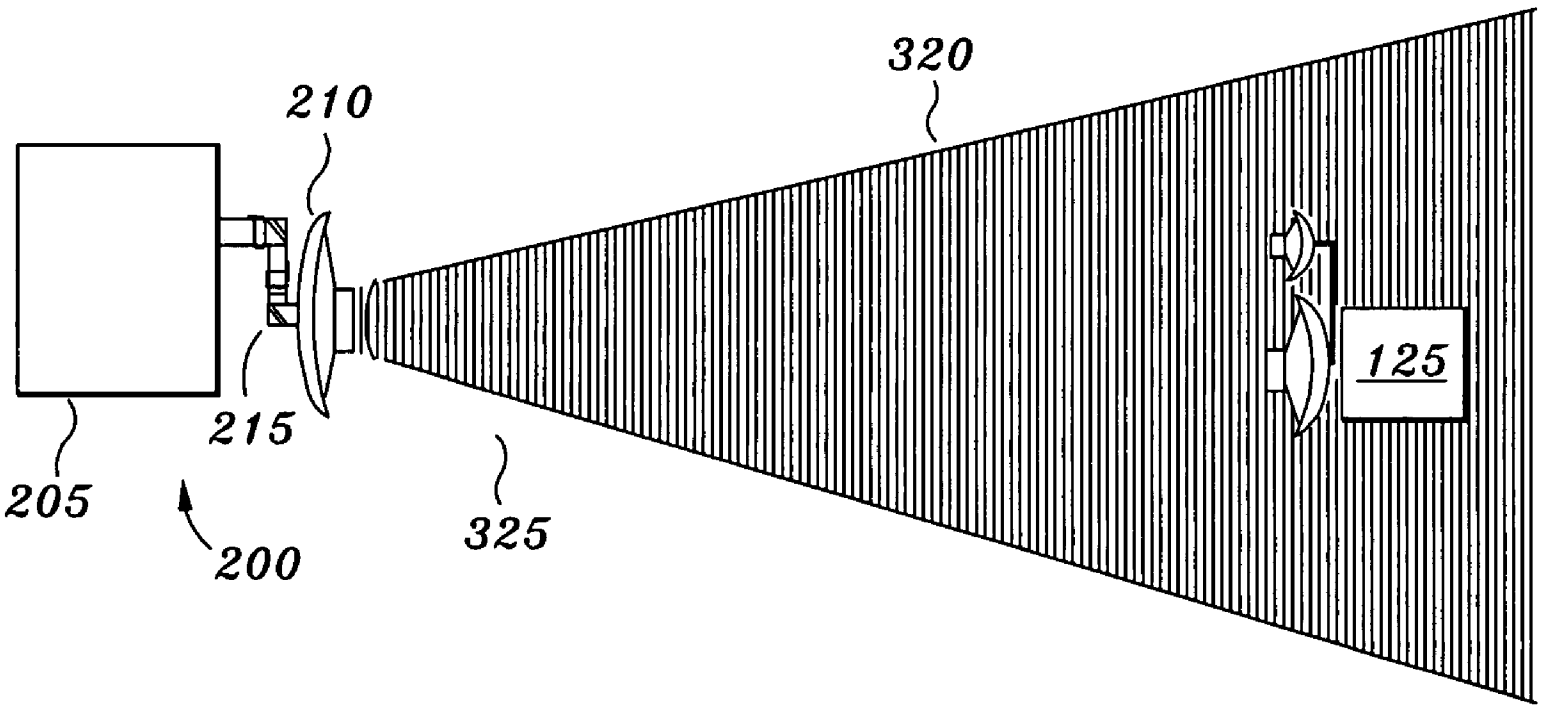
FIG. 6 is a diagram of a transmitting satellite and a receiving satellite in cross-communication according to an embodiment of the present invention.

Referring to FIG. 6, dispersed beam 320 may be configured to be received by a satellite, such as satellite 125, for initial acquisition of the first frequency band and track the dispersed beam to acquire collimated beams 325 and 335. Both the first and second frequency bands may be modulated with the first frequency band carrying information at a higher rate than the second frequency band.

According to one embodiment, control electronics 350 (see FIG. 2) for modulating the first and second frequencies and for other control functions (e.g., gimbal control) are housed within satellite bus 205. Housing the control electronics within the satellite bus provides that the control electronics may be made relatively light. For example, relatively light shielding may be used to shield the control electronics as shielding from surrounding systems form a partial shield. In addition, relatively less hardening may be employed to shield the control electronics.

According to one embodiment, the mass of illuminating reflector 210 and control arm 215 (i.e., outboard mass) is less than about 150 pounds, and according to a specific embodiment is about 120 pounds or less. According to another embodiment, the combined weight of control electronics 350 and the outboard mass is about 250 pounds or less, and according to a specific embodiment is about 230 pounds or less.

Figure 7:
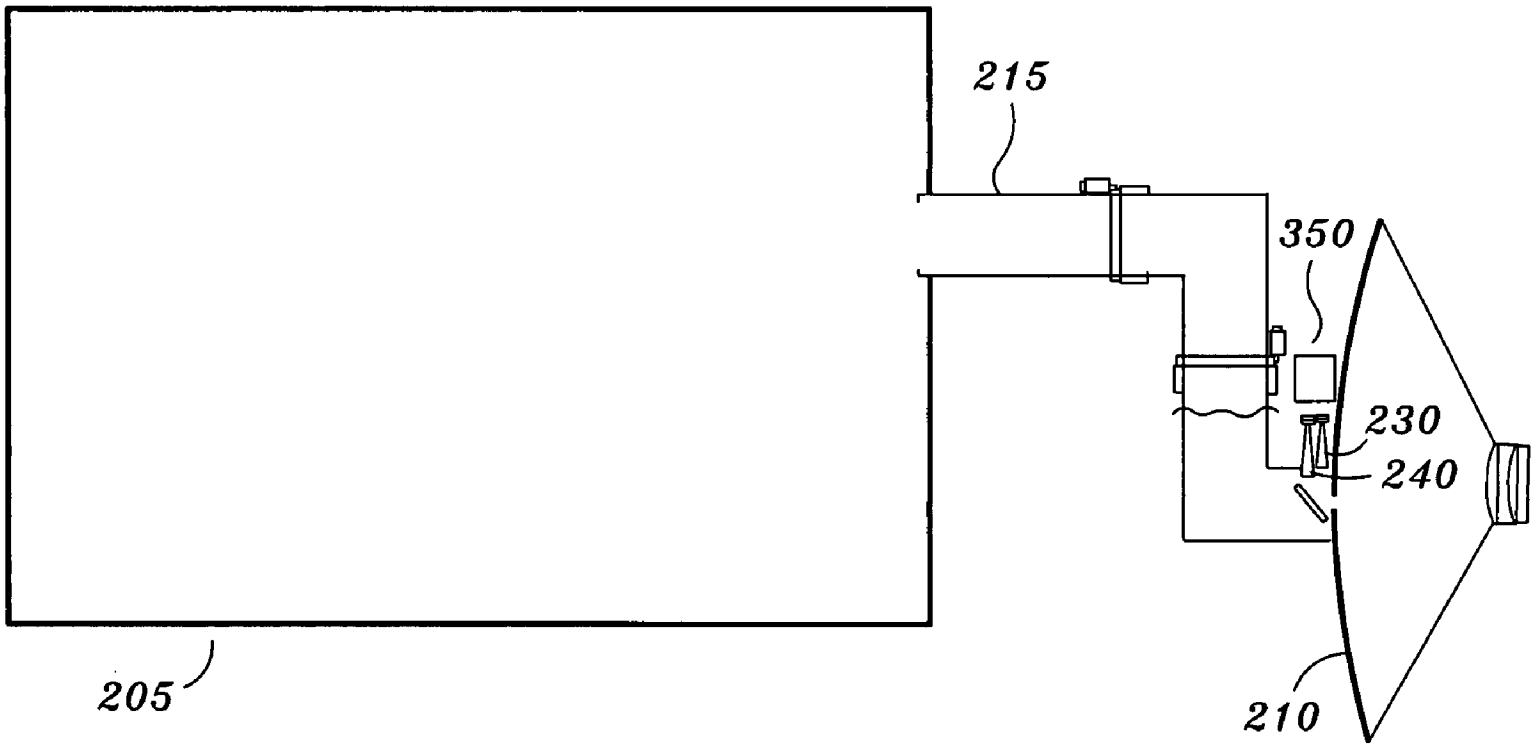
FIG. 7 is a simplified schematic of a satellite according to another embodiment of the present invention.

It should also be understood that the examples and embodiments described herein are for illustrative purposes only and that various modifications or changes in view thereof will be suggested to persons skilled in the art and are to be included within the spirit and purview of this application and scope of the appended claims. For example, while embodiments herein are described as transmitting first and second frequency bands, more than two frequency bands may be transmitted by illuminating reflectors described herein. Also, while one of the frequency bands is described as being transmitted in a collimated and dispersed beam, more than one frequency band may be similarly transmitted. Moreover, those of skill in the art will readily understand that the illuminating reflectors described herein may also be configured to collect frequency bands transmitted by other satellites as well as terrestrial transmitters and that the control electronics may be configured to demodulate and decode such transmissions. Moreover, while control electronics 350, first feed horn 230, and second feed horn 240 are shown as being disposed in the satellite bus, these modules may be disposed outside of the bus, such as adjacent to illuminating reflector 210 as shown in FIG. 7. In the embodiment shown in FIG. 7, the control electronics and feed horns may be mounted on the control arm, the backside of the reflector or other structure. According to the embodiment shown in FIG. 7, control arm 215 might not include a waveguide, but might be gimbaled for illuminating reflector control. According to another embodiment, control arm 215 may include a waveguide to direct additional frequency bands (e.g., in addition to the first and second frequency bands) between the satellite bus and illuminating reflector 210. Therefore, the above description should not be taken as limiting the scope of the invention as defined by the claims. All publications, patents, and patent applications cited herein are hereby incorporated by reference for all purposes in their entirety.

What is claimed is:

1. An illuminating-reflector system for transmitting first and second frequency bands for satellite and terrestrial communications, the system comprising:

a first reflector configured to transmit a first portion of the first frequency band in an dispersed beam, to reflect a second portion of the first frequency band, and to transmit the second frequency band;

a second reflector configured to reflect the second frequency band transmitted by the first reflector and to transmit the first portion of the first frequency band; and a primary reflector configured to receive the second portion of the first frequency band reflected from the first reflector, to receive the second frequency band reflected from the second reflector, and to reflect the second portion of the first frequency band and the second frequency band in a substantially collimated beam.

2. The system of claim 1, further comprising control electronics disposed in a satellite bus and configured to control a transmission direction of the dispersed beam and the substantially collimated beam.

3. The system of claim 1, wherein the first reflector is disposed between the second reflector and the primary reflector.

4. The system of claim 1, wherein the dispersed beam is configured to be acquired by a satellite for initial acquisition and automatic tracking of the system.

5. The system of claim 1, further comprising a dispersive lens configured to receive the first and second frequency bands from a beam waveguide and transmit the first second frequency bands to the first reflector.

6. The system of claim 5, wherein the primary reflector includes an aperture formed therein to pass the first and second frequency bands from the dispersive lens to the first reflector.

7. The system of claim 5, wherein:

the dispersive lens is configured to disperse the first frequency band; and a wavefront diameter of the first frequency band at the first reflector is approximately equal to a diameter of the first reflector.

8. The system of claim 5, wherein:

the dispersive lens is configured to disperse the second frequency band; and a wavefront diameter of the second frequency band at the second reflector is approximately equal to a diameter of the second reflector.

9. The system of claim 1, wherein the first portion includes about five percent or less of the power the first frequency band.

10. The system of claim 1, wherein the second portion includes about ninety-five percent or more of the power of the first frequency band.

11. The system of claim 1, wherein the first frequency band includes at least one of the millimeter band, the microwave band, the Ka-band, and the V-band.

12. The system of claim 1, wherein the second frequency band includes a Ka-band.

13. The system of claim 1, wherein the primary reflector has a diameter of about six feet.

14. The system of claim 1, wherein the first reflector has a diameter of greater than or equal to about 4 inches.

15. The system of claim 1, wherein a gain of the primary reflector is greater than or equal to about 59 dB.

16. The system of claim 1, wherein a gain of the primary reflector is about 59.5 dB.

17. The system of claim 1, wherein a gain of the first reflector is less than or equal to about −33 dBi relative to a gain of the primary reflector.

18. A satellite for dual-frequency cross-link communications with at least one other satellite and at least one terrestrial-communications receiver, the satellite comprising:

a dual-frequency-illuminating reflector configured to transmit a first frequency band in a first collimated beam and in an dispersed beam and to transmit a second frequency band in a second collimated beam.

19. The satellite of claim 18, further comprising a satellite bus operatively coupled to the dual-frequency-illuminating reflector.

20. The satellite of claim 19, further comprising control electronics disposed in the satellite bus and configured to slew the dual-frequency-illuminating reflector.

21. The satellite of claim 18, wherein the dispersed beam is a low-gain beam.

22. The satellite of claim 18, wherein the first and second collimated beams are high-gain beams.

23. The satellite of claim 18, wherein diameters of the first and second collimated beams are approximately equal.

24. The satellite of claim 18, wherein the dual-frequency-illuminating reflector includes:

a first reflector configured to transmit a first portion of the first frequency band in an dispersed beam, to reflect a second portion of the first frequency band, and to transmit the second frequency band;

a second reflector configured to reflect the second frequency band transmitted by the first reflector and to transmit the first portion of the first frequency band; and a primary reflector configured to receive the second portion of the first frequency band reflected from the first reflector, to receive the second frequency band reflected from the second reflector, and to reflect the second portion of the first frequency band and the second frequency band in a substantially collimated beam.

25. The satellite of claim 24, wherein the first reflector is disposed between the second reflector and the primary reflector.

26. The satellite of claim 18, wherein the dispersed beam is configured to be acquired by another satellite for initial acquisition and automatic tracking of the first-mentioned satellite.

27. The satellite of claim 18, further comprising a dispersive lens configured to receive the first and second frequency bands from a beam waveguide and transmit the first second frequency bands to the first reflector.

28. The satellite of claim 27, wherein the primary reflector includes an aperture formed therein to pass the first and second frequency bands from the dispersive lens to the first reflector.

29. The satellite of claim 27, wherein:

the dispersive lens is configured to disperse the first frequency band; and a wavefront diameter of the first frequency band at the first reflector is approximately equal to a diameter of the first reflector.

30. The satellite of claim 27, wherein:

the dispersive lens is configured to disperse the second frequency band; and a wavefront diameter of the second frequency band at the second reflector is approximately equal to a diameter of the second reflector.

31. The satellite of claim 18, wherein the first portion includes about five percent or less of the power of the first frequency band.

32. The satellite of claim 18, wherein the second portion includes about ninety-five percent or more of the power of the first frequency band.

33. The satellite of claim 18, wherein the first frequency band includes at least one of the millimeter band, the microwave band, the Ka-band, and the V-band.

34. The satellite of claim 18, wherein the second frequency band includes a Ka-band.

35. The satellite of claim 18, wherein the primary reflector has a diameter greater than or equal to about six feet.

36. The satellite of claim 18, wherein the first reflector has a diameter of greater than or equal to about 4 inches.

37. The satellite of claim 18, wherein a diameter of the second reflector is between a diameter of the first reflector and a diameter of the primary reflector.

38. The satellite of claim 18, wherein a gain of the primary reflector is greater than or equal to about 59 dB.

39. The satellite of claim 18, wherein a gain of the primary reflector is about 59.5 dB.

40. The satellite of claim 18, wherein a gain of the first reflector is less than or equal to about −33 dBi relative to a gain of the primary reflector.

* * * * *